US005671818A

United States Patent [19]

Newton et al.

[11] Patent Number: 5,671,818

[45] Date of Patent: Sep. 30, 1997

[54] ROTARY DRILL BITS

[75] Inventors: Alex Newton, Houston, Tex.; Malcolm R. Taylor, Gloucester, England; Andrew Murdock, Stonehouse, England; John M. Clegg, Redland, England

[73] Assignee: Camco Drilling Group Limited, Stonehouse, England

[21] Appl. No.: 541,774

[22] Filed: Oct. 10, 1995

[30] Foreign Application Priority Data

Oct. 15, 1994 [GB] United Kingdom ..... 9420838
Sep. 8, 1995 [GB] United Kingdom ..... 9518267

[51] Int. Cl.[6] ..... E21B 10/60

[52] U.S. Cl. ..... 175/393

[58] Field of Search ..... 175/393, 428, 175/399, 430, 400, 417, 429, 431

[56] References Cited

U.S. PATENT DOCUMENTS

| | | | |
|---|---|---|---|
| 3,111,179 | 11/1963 | Albers et al. | 175/393 |
| 3,951,220 | 4/1976 | Phillips, Jr. et al. | 175/393 |
| 4,733,735 | 3/1988 | Barr et al. | 175/417 X |
| 5,029,657 | 7/1991 | Mahar et al. | 175/393 |
| 5,145,017 | 9/1992 | Holster et al. | 175/393 X |
| 5,199,511 | 4/1993 | Tibbitts et al. . | |
| 5,244,039 | 9/1993 | Newton et al. . | |
| 5,417,296 | 5/1995 | Murdock | 175/393 |
| 5,452,628 | 9/1995 | Montgomery, Jr. et al. | 175/393 X |

FOREIGN PATENT DOCUMENTS

| | | |
|---|---|---|
| 713998 | 8/1954 | United Kingdom . |
| 2298666 | 9/1996 | United Kingdom . |
| 94/12760 | 6/1994 | WIPO . |

*Primary Examiner*—Frank Tsay

[57] ABSTRACT

A rotary drill bit for use in drilling holes in subsurface formations comprises a bit body having a leading face and a gauge region, a number of blades formed on the leading face of the bit and extending outwardly away from the axis of the bit so as to define between the blades a number of fluid channels leading towards the gauge region, a number of cutting elements mounted side-by-side along each blade, and a number of nozzles in the bit body for supplying drilling fluid to the fluid channels for cleaning and cooling the cutting elements. In at least one of the fluid channels, adjacent the gauge region, is an opening into an enclosed passage which passes internally through the bit body to an outlet which, in use, communicates with the annulus between the drill string and the wall of the borehole being drilled. The portion of the gauge region outwardly of the opening comprises a bearing surface which, in use bears against the wall of the bore hole and extends across the width of the channel.

15 Claims, 3 Drawing Sheets

ROTARY DRILL BITS

BACKGROUND OF THE INVENTION

The invention relates to rotary drill bits for use in drilling holes in subsurface formations, and of the kind comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality &cutting elements mounted along each blade, and a plurality of nozzles in the bit body for supplying drilling fluids to the channels for cleaning and cooling the cutting elements.

The invention is particularly, but not exclusively, applicable to drill bits in which some or all of the cutters are preform (PDC) cutters each formed, at least in part, from polycrystalline diamond. One common form of cutter comprises a tablet, usually circular or part circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder inner furnace so as to form a hard matrix.

In the normal prior art construction the gauge region of the drill bit is formed by a plurality of kickers which are spaced apart around the outer periphery of the bit body and are formed with bearing surfaces which, in use, bear against the wall of the bore hole. The kickers generally form continuations of the respective blades, and the spaces between the kickers define junk slots with which the channels between the blades communicate. Drilling fluid flowing outwardly along each channel flows into the junk slot at the end of the channel and passes upwardly through the junk slot into the annulus between the drill string and the wall of the borehole.

While such PDC bits have been very successful in drilling relatively soft formations, they have been less successful in drilling harder formations, and soft formations which include harder or occlusions or stringers. Although good rates of penetration are possible in harder formations, the PDC cutters may suffer accelerated wear and bit life can be too short to be commercially acceptable.

Studies have suggested that the rapid wear of PDC bits in harder formations may be due to chipping of the cutters as a result of impact loads caused by vibration of the drill bit. One of the most harmful types of vibration can be attributed to a phenomenon called "bit whirl".

It is believed that the stability of such a drill bit, and its ability to resist vibration, may be enhanced by increasing the area of the bearing surfaces on the gauge region which engage the wall of the borehole. In the prior art designs, however, the area of engagement can only be increased by increasing the length and/or width of the bearing surfaces on the kickers. It may be undesirable to increase the length of the bearing surfaces since this may lead to difficulties in steering the bit in steerable drilling systems. Similarly, increasing the circumferential width of the bearing surfaces necessarily reduces the width of the junk slots between the bearing surfaces, and this may lead to less than optimum hydraulic flow of drilling fluid along the channels and over the cutters, and may lead to blockage of the junk slots and channels by debris.

The present invention provides arrangements whereby the bearing surface area of the gauge region of a drill bit of the kind first referred to may be increased without the above-mentioned disadvantages, and which may also give rise to other advantages.

SUMMARY OF THE INVENTION

According to the invention there is provided a rotary drill bit for use in drilling holes in subsurface formations comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality of cutting elements mounted along each blade, and a plurality of nozzles in the bit body for supplying drilling fluid to the channels for cleaning and cooling the cutting elements, wherein there is provided in at least one of said channels, adjacent the gauge region, an opening into an enclosed passage which passes internally through the bit body to an outlet which, in use, communicates with the annulus between the drill string and the wall of the borehole being drilled, the portion of the gauge region outwardly of said opening comprising a bearing surface which, in use bears against the wall of the bore hole and extends across the width of said one channel.

Preferably there is provided in said passage a nozzle for supplying drilling fluid, and said nozzle may be at least partly directed towards said opening so as to deliver drilling fluid through said opening and into and inwardly along said one channel. Alternatively the nozzle may be at least partly directly towards said outlet from the passage, so as to deliver drilling fluid through said outlet to the annulus. The nozzle may be mounted in a socket in a wall of said passage, the axis of the socket and of the nozzle being inclined with respect to the axis of the passage.

At least one nozzle for supplying drilling fluid may be so located on the bit body as to deliver to said one channel a supply of drilling fluid which flows outwardly along said channel towards the gauge region. The nozzle may be located in said one channel, for example adjacent the inner end thereof. Alternatively said one channel may be in communication with another channel defined between blades on the bit body, and a further nozzle for supplying drilling fluid may be so located on the bit body as to deliver to said other channel a supply of drilling fluid which flows first inwardly along said other channel and then outwardly along said one channel towards said opening. The further nozzle may be located adjacent the outer end of said other channel.

In any of the above arrangements, each channel on the bit body which is not provided with an opening into an enclosed passage may lead at its outer extremity to an outwardly facing junk slot formed in the gauge section and leading to the annulus.

A plurality of said channels on the bit body may each be formed with an opening into an enclosed passage which passes internally through the bit body to an outlet which, in use, communicates with the annulus between the drill string and the wall of the borehole being drilled, a portion of the gauge region outwardly of each said opening comprising a bearing surface which, in use, bears against the wall of the bore hole and extend across the outer extremity of the respective channel.

In this case, the bearing surfaces at the outer extremities of adjacent channels formed with said openings are preferably connected to form a substantially continuous bearing surface extending across the combined widths of the adjacent channels.

All of said channels on the bit body may each be formed with an opening into an enclosed passage which passes internally through the bit body to an outlet which, in use, communicates with the annulus between the drill string and the wall of the bore hole being drilled, the portions of the gauge region outwardly of said openings comprising a substantially continuous bearing surface extending around substantially the whole of the gauge region.

In any of the above arrangements at least one of the channels may be provided with a plurality of openings each of which leads into an enclosed passage which passes internally through the bit body to an outlet which, in use, communicates with the annulus between the drill string and the wall of the borehole being drilled, the portion of the gauge region outwardly of the said openings comprising a bearing surface which, in use, bears against the wall of the bore hole and extends across the width of the channel.

Each enclosed passage passing internally through the bit body may extend generally parallel to the longitudinal central axis of the drill bit.

DETAILED DESCRIPTION OF THE PREFERRED EMBODIMENTS

Figure 1:
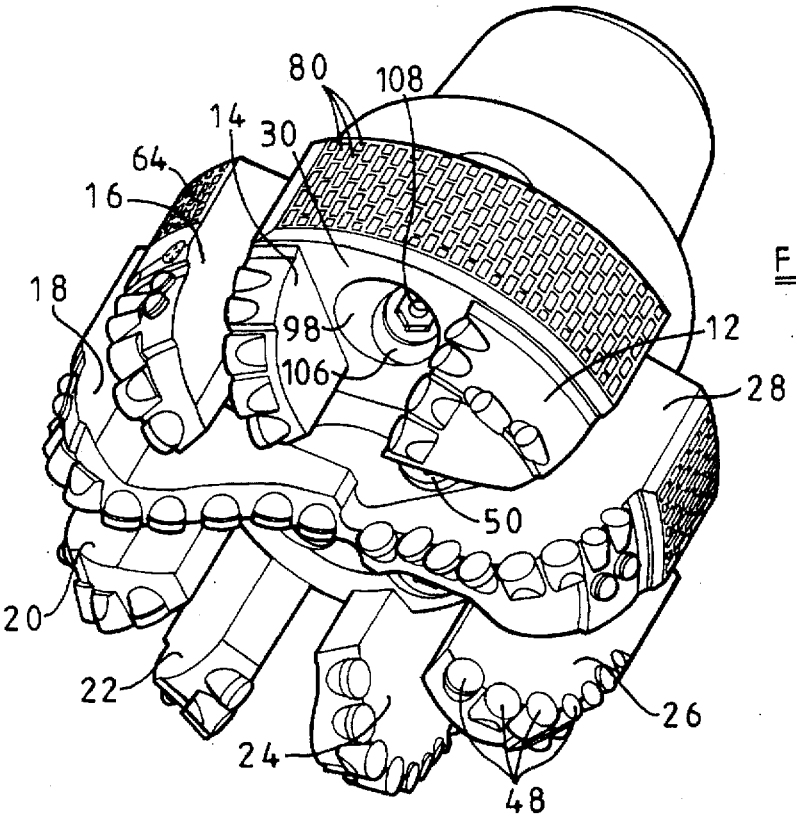
FIG. 1 is a perspective view of a PDC drill bit in accordance with the present invention.
Figure 2:
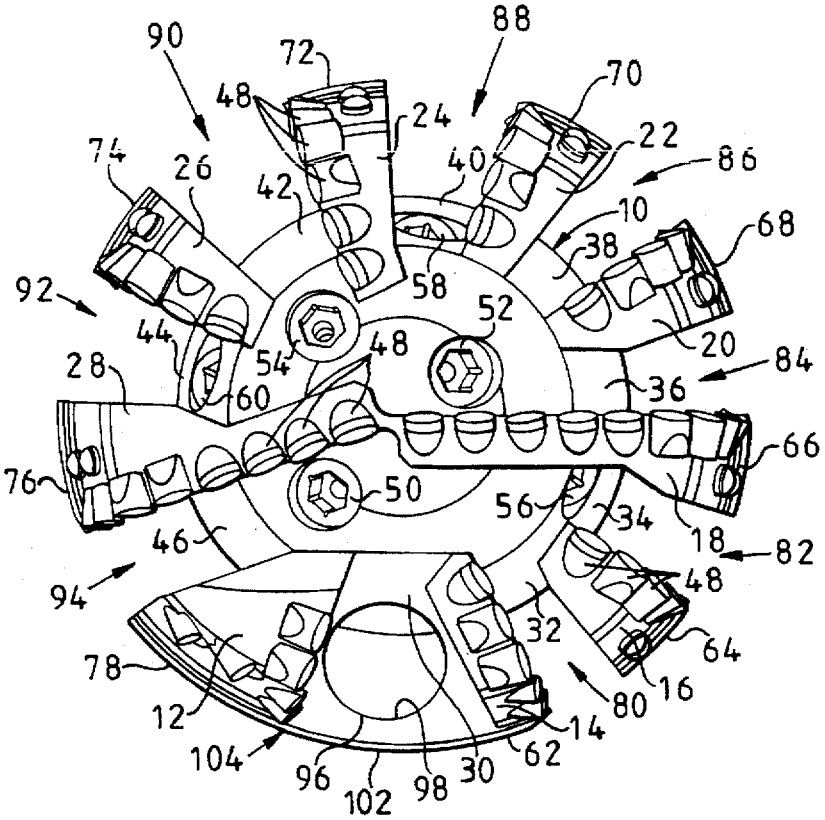
FIG. 2 is an end view of the drill bit shown in FIG. 1.

Referring to the drawings: the drill bit comprises a bit body 10 and nine blades 12, 14, 16, 18, 20, 22, 24, 26 and 28 formed on the leading face of the bit and extending outwardly from the axis of the bit body towards the gauge region. Between adjacent blades there are defined channels 30, 32, 34, 36, 38, 40, 42, 44 and 46.

Extending side-by-side along each of the blades are a plurality of cutting structures, indicated at 48. The precise nature of the cutting structures does not form a part of the present invention and they may be of any appropriate type. For example, as shown, they may comprise circular pre-formed cutting elements brazed to cylindrical carriers which are embedded or otherwise mounted in the blades, the cutting elements each comprising a pre-formed compact having a polycrystalline diamond front cutting layer bonded to a tungsten carbide substrate, the compact being brazed to a cylindrical tungsten carbide carrier. In another form of cutting structure the substrate of the preformed compact is of sufficient axial length to be mounted directly in the blade, the additional carrier then being omitted.

Back-up abrasion elements or cutters may be spaced rearwardly of some of the cutting structures, as shown.

Inner nozzles 50, 52, 54 are mounted in the surface of the bit body and are located fairly close to the central axis of rotation of the bit. Each inner nozzle is so located that it can deliver drilling fluid to two or more channels. In addition, peripheral nozzles 56, 58 and 60 are located in the channels 34, 40 and 44 respectively and are orientated to direct drilling fluid inwardly along their respective channels towards the centre of the drill bit. All of the nozzles communicate with a central axial passage (not shown) in the shank of the bit, to which drilling fluid is supplied under pressure downwardly through the drill string in known manner.

The outer extremities of the blades are formed with axially extending kickers 62, 64, 66, 68, 70, 72, 74, 76 and 78 respectively, which provide part-cylindrical bearing surfaces which, in use, bear against the surrounding wall of the borehole and stabilise the bit in the borehole. Abrasion-resistant bearing elements 80, of any suitable known form, are embedded in the bearing surfaces.

Each of the channels 32, 34, 36, 38, 40, 42, 44, 46 leads to a respective junk slot 80, 82, 84, 86, 88, 90, 92, 94. The junk slots extend upwardly between the kickers, generally parallel to the central longitudinal axis of the drill bit, so that drilling fluid flowing outwardly along each channel passes into the associated junk slot and flows upwardly, between the bit body and the surrounding formation, into the annulus between the drill string and the wall of the borehole.

Figure 3:
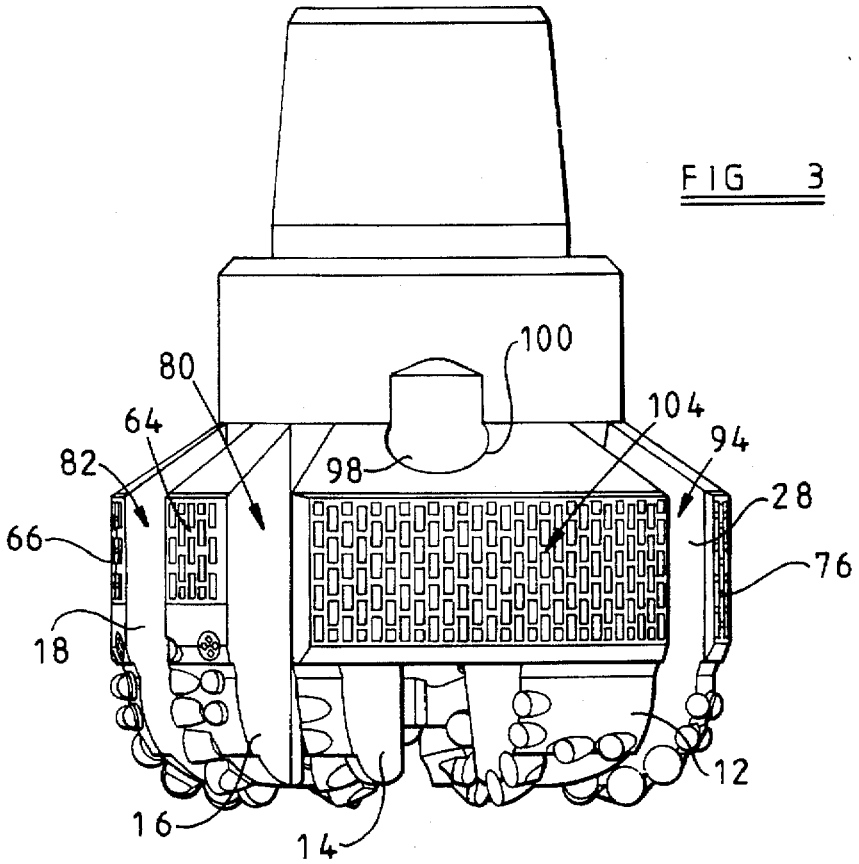
FIG. 3 is a side elevation of the drill bit.

In accordance with the present invention the channel 30 between the blades 12 and 14 does not lead to a conventional junk slot but continues right up to the gauge region of the drill bit. Formed in the channel 30 adjacent the gauge region is a circular opening 96 into a enclosed cylindrical passage 98 which extends through the bit body to an outlet 100 (see FIG. 3) which communicates with the annulus.

The bearing surfaces 78 and 62 at the outer extremities of the blades 12 and 14 are connected by an intermediate bearing surface 102 which extends across the width of the channel 30 so as to form, with the bearing surfaces 78 and 62 a large continuous part-cylindrical bearing surface 104.

As best seen in FIG. 1, a cylindrical socket 106 is formed in the side wall of the passage 98 and is inclined at an angle to the longitudinal axis of the passage. A nozzle 108 is mounted in the socket 106 and is angled to direct drilling fluid along the passage 98 towards the opening 96, so that the drilling fluid emerges from the opening and flows inwardly along the channel 30.

Thus, in the case of the channel 30, the conventional junk slot is replaced by the enclosed passage 98 which passes internally through the bit body. This enables the provision on the adjacent part of the gauge region of a bearing surface 104 of extended peripheral extent, and this increased bearing surface may enhance the stability of the drill bit in the borehole.

Figure 4:
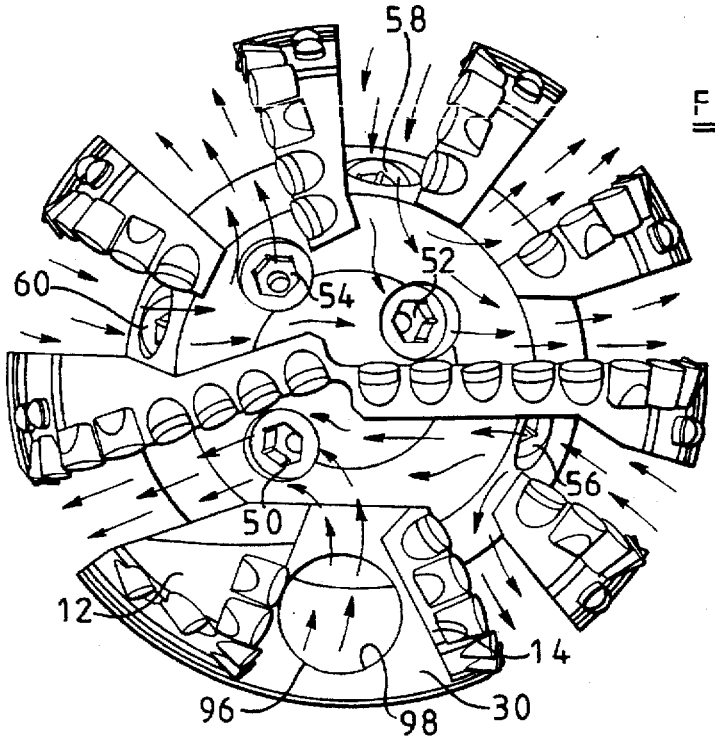
FIG. 4 is a similar view to FIG. 2 showing diagrammatically the hydraulic flow over the surface of the drill bit.

FIG. 4 shows diagrammatically a typical pattern of flow of drilling fluid over the face of the bit. It will be seen that drilling fluid flows inwardly, as indicated by the arrows, from the peripheral nozzles 108, 56, 58 and 60 towards the centre of the bit and then across the face of the bit to flow outwardly along other channels, the outward flow being reinforced by the flow from the inner nozzles 50, 52, 54.

However, other flow patterns are possible and may be achieved by appropriate location and orientation of the nozzles. For example, the nozzle 108 in the passage 98 may be orientated so as to direct a flow of drilling fluid upwardly through the passage 98 towards the outlet 100, in which case the flow along the channel 30 will be in an outward direction towards the opening 96. Alternatively, the nozzle 108 may be omitted altogether, and in this case also drilling fluid will flow outwardly along the channel 30, such flow being derived, for example, from the nozzles 50 and 56.

FIGS. 1 to 4 show an enclosed passage in only one of the channels. However, the invention includes within its scope arrangements in which two or more of the channels do not lead to conventional open junk slots but are closed at their outer extremity by a bearing surface in the gauge region, there being provided in each channel an enclosed passage, similar to the passage 98, which passes through the bit body. It will be appreciated that for each channel which is constructed in this manner the overall bearing surface area of the gauge region will be increased. In some cases it may be desirable to replace all the junk slots by enclosed passages similar to the passage 98, in which case the whole of the gauge region of the drill bit will comprise a continuous and uninterrupted 360° bearing surface engaging the wall of the borehole.

Although the passage 98 is described as being a cylindrical passage parallel to the longitudinal axis of the drill bit, other arrangements are possible. For example, the passage may vary in cross-sectional shape and/or diameter along its length. Two or more openings may be provided in the channel, the openings leading to separate passages through the bit body, or two or more openings may lead into a single passage.

Figure 5:
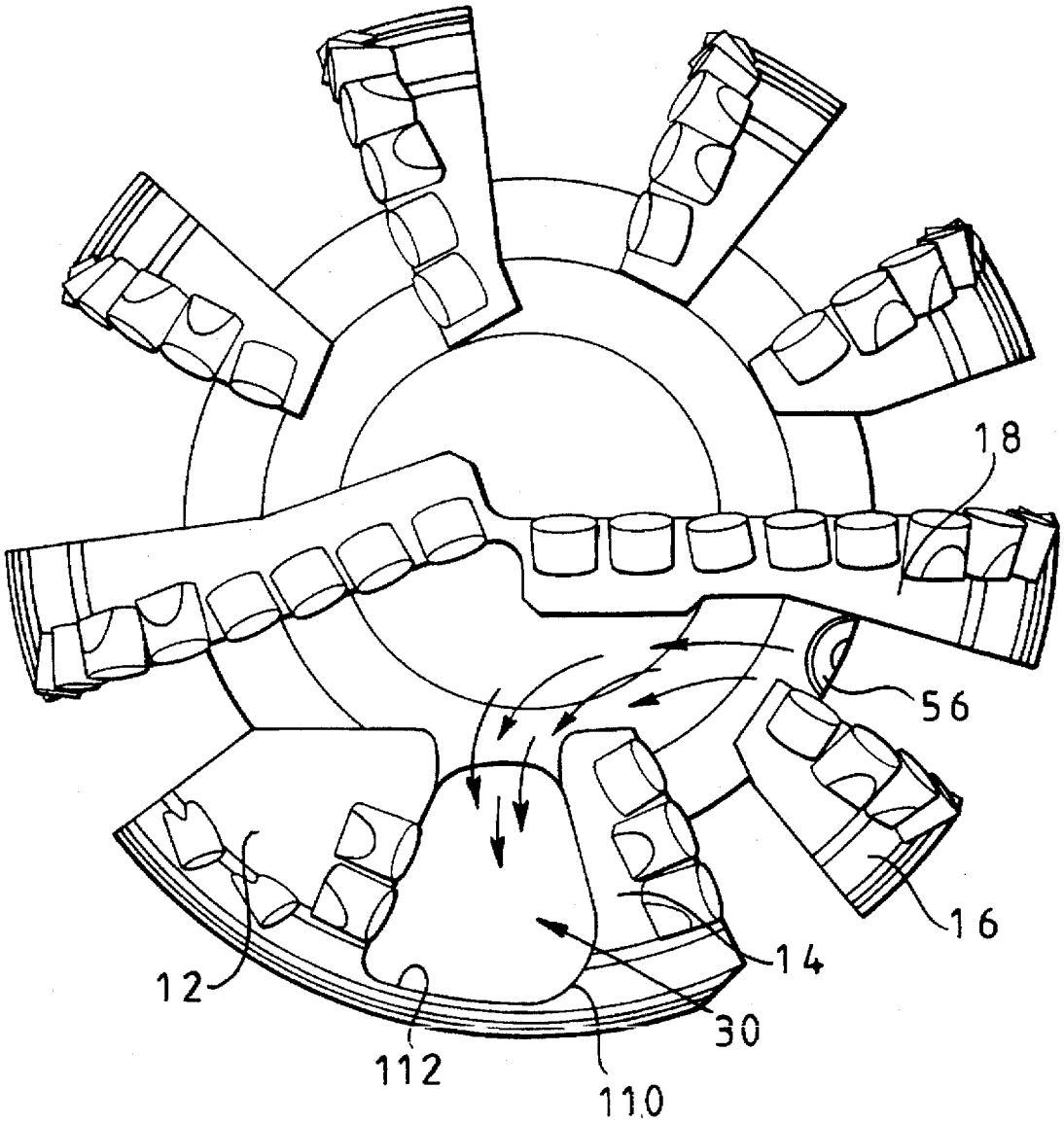
FIG. 5 is a similar view to FIG. 2 of an alternative form of drill bit in accordance with the invention.

FIG. 5 shows an alternative arrangement where the opening 110 into the passage 112 is irregularly shaped so as to extend over almost all of the entire area of the channel 30 between the blades 12 and 14. In this case a nozzle is not provided in the passage 112 and the flow of drilling fluid along the channel 30 and through the passage 112 is derived from the peripheral nozzle 56, as indicated by the arrows in FIG. 5.

We claim:

1. A rotary drill bit for connection to a drill string and for drilling boreholes in subsurface formations comprising a bit body having a leading face and a gauge region, a plurality of blades formed on the leading face of the bit and extending outwardly away from the axis of the bit towards the gauge region so as to define between the blades a plurality of fluid channels leading towards the gauge region, a plurality of cutting elements mounted along each blade, and a plurality of nozzles in the bit body for supplying drilling fluid to the channels for cleaning and cooling the cutting elements, wherein there is provided in at least one of said channels, adjacent the gauge region, an opening into an enclosed passage which passes internally through the bit body to an outlet which, in use, communicates with the annulus between the drill string and the wall of the borehole being drilled, the portion of the gauge region outwardly of said opening comprising a bearing surface which, in use bears against the wall of the bore hole and extends across the width of said one channel, thereby to inhibit flow of drilling fluid from said one channel across the gauge region of the drill bit.

2. A drill bit according to claim 1, wherein there is provided in said passage a nozzle for supplying drilling fluid, said nozzle being at least partly directed towards said opening so as to deliver drilling fluid through said opening and into and inwardly along said one channel.

3. A drill bit according to claim 1, wherein there is provided in said passage a nozzle for supplying drilling fluid, said nozzle being at least partly directly towards said outlet from the passage, so as to deliver drilling fluid through said outlet to the annulus.

4. A drill bit according to claim 1, wherein there is provided in said passage a nozzle for supplying drilling fluid, said nozzle being mounted in a socket in a wall of said passage, the axis of the socket and of the nozzle being inclined with respect to the axis of the passage.

5. A drill bit according to claim 1, wherein at least one nozzle for supplying drilling fluid is so located on the bit body as to deliver to said one channel a supply of drilling fluid which flows outwardly along said channel towards the gauge region.

6. A drill bit according to claim 5, wherein said nozzle is located in said one channel.

7. A drill bit according to claim 6, wherein said one channel has an inner end and an outer end and wherein said nozzle is located adjacent the inner end of said one channel.

8. A drill bit according to claim 5, wherein said one channel is in communication with another channel defined between blades on the bit body, and wherein a further nozzle for supplying drilling fluid is so located on the bit body as to deliver to said other channel a supply of drilling fluid which flows first inwardly along said other channel and then outwardly along said one channel towards said opening.

9. A drill bit according to claim 8, wherein said one channel has an inner end and an outer end and wherein said further nozzle is located adjacent the outer end of said other channel.

10. A drill bit according to claim 1, wherein each channel on the bit body which is not provided with an opening into an enclosed passage leads at its outer extremity to an outwardly facing junk slot formed in the gauge section and leading to the annulus between the drill string and the wall of the borehole being drilled.

11. A drill bit according to claim 1, wherein a plurality of said channels on the bit body are each formed with an opening into an enclosed passage which passes internally through the bit body to an outlet which, in use, communicates with the annulus between the drill string and the wall of the borehole being drilled, a portion of the gauge region outwardly of each said opening comprising a bearing surface which, in use, bears against the wall of the bore hole and extends across the outer extremity of the respective channel.

12. A drill bit according to claim 11 wherein the bearing surfaces at the outer extremities of adjacent channels formed with said openings are connected to form a substantially continuous bearing surface extending around part of the gauge region and across the combined widths of the adjacent channels.

13. A drill bit according to claim 12 wherein all of said channels on the bit body are each formed with an opening into an enclosed passage which passes internally through the bit body to an outlet which, in use, communicates with the annulus between the drill string and the wall of the bore hole being drilled, the portions of the gauge region outwardly of said openings comprising a substantially continuous bearing surface extending around substantially the whole of the gauge region.

14. A drill bit according to claim 1, wherein at least one of said channels is provided with a plurality of openings each of which leads into an enclosed passage which passes internally through the bit body to an outlet which, in use, communicates with the annulus between the drill string and the wall of the borehole being drilled, the portion of the gauge region outwardly of the said openings comprising a bearing surface which, in use, bears against the wall of the bore hole and extends across the width of the channel.

15. A rotary drill bit according to claim 1, wherein each enclosed passage passing internally through the bit body extends generally parallel to the longitudinal central axis of the drill bit.

* * * * *